US012150471B2

(12) United States Patent
Fujikura et al.

(10) Patent No.: US 12,150,471 B2
(45) Date of Patent: Nov. 26, 2024

(54) TOBACCO ROD FOR FLAVOR INHALER

(71) Applicant: Japan Tobacco Inc., Tokyo (JP)

(72) Inventors: Hirofumi Fujikura, Tokyo (JP); Kaori Takai, Tokyo (JP); Takeshi Shinkawa, Tokyo (JP); Kimitaka Uchii, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 0 days.

(21) Appl. No.: 17/527,569

(22) Filed: Nov. 16, 2021

(65) Prior Publication Data

US 2022/0071266 A1 Mar. 10, 2022

Related U.S. Application Data

(63) Continuation of application No. PCT/JP2019/019656, filed on May 17, 2019.

(51) Int. Cl.
*A24B 3/14* (2006.01)

(52) U.S. Cl.
CPC ..... *A24B 3/14* (2013.01)

(58) Field of Classification Search
None
See application file for complete search history.

(56) References Cited

U.S. PATENT DOCUMENTS

| | | | | |
|---|---|---|---|---|
| 2002/0062834 | A1* | 5/2002 | Snaidr | A24D 1/02 131/365 |
| 2013/0160780 | A1 | 6/2013 | Matsumoto et al. | |
| 2014/0246033 | A1 | 9/2014 | Daehne et al. | |
| 2018/0177228 | A1 | 6/2018 | Pijnenburg et al. | |
| 2019/0230991 | A1* | 8/2019 | Liu | A24F 40/30 |
| 2020/0229485 | A1 | 7/2020 | Gindrat | |
| 2021/0368859 | A1* | 12/2021 | Watanabe | A24D 1/042 |

FOREIGN PATENT DOCUMENTS

| | | | |
|---|---|---|---|
| JP | 6017546 | B2 | 11/2016 |
| JP | 2017-524368 | A | 8/2017 |
| WO | WO 2012/026481 | A1 | 3/2012 |
| WO | WO 2016/023965 | A1 | 2/2016 |

OTHER PUBLICATIONS

International Search Report, issued in PCT/JP2019/019656, dated Aug. 13, 2019.
Extended European Search Report for European Application No. 19929783.9, dated Nov. 29, 2022.

* cited by examiner

*Primary Examiner* — Katherine A Will
(74) *Attorney, Agent, or Firm* — Birch, Stewart, Kolasch & Birch, LLP

(57) ABSTRACT

A tobacco rod for a flavor inhaler includes a cylindrical container, and a flavor source including tobacco filled in the cylindrical container, in which the flavor source is filled in such a manner as to form voids over a longitudinal direction, and the following relationship is satisfied: $S/T \leq 17\%$, wherein T represents an area of all voids present in a cross-section of the flavor source orthogonal to the longitudinal direction of the cylindrical container, and S represents a total area of voids each having an area of 800000 $\mu m^2$ or more in the cross-section.

20 Claims, 4 Drawing Sheets

TOBACCO ROD FOR FLAVOR INHALER

CROSS REFERENCE TO RELATED APPLICATIONS

The present application is a continuation application of International Application No. PCT/JP2019/019656, filed on May 17, 2019, which is hereby expressly incorporated by reference into the present application.

TECHNICAL FIELD

The present invention relates to a tobacco rod for a flavor inhaler, and more particularly, it relates to a tobacco rod for a direct heating type or indirect heating type flavor inhaler.

BACKGROUND ART

A direct heating type flavor inhaler and an indirect heating type flavor inhaler have been developed to be used instead of a conventional combustion type smoking article. PTL 1 discloses, regarding a tobacco rod directly heated for use, a method for discriminating between a non-defective item and a defective item comprising a step of performing image analysis of a cross-sectional void fraction or a cross-sectional void fraction distribution, and discloses an aerosol generating substrate obtained by the method. PTL 2 discloses a heating type smoking article including a gathered or crimped tobacco material sheet.

CITATION LIST

Patent Literature

PTL 1: Japanese Translation of PCT International Application Publication No. 2017-524368
PTL 2: Japanese Patent No. 6017546

SUMMARY OF INVENTION

Technical Problem

A flavor source of a direct heating type flavor inhaler is heated at a lower temperature than a conventional combustion type tobacco, and a flavor source of an indirect heating type flavor inhaler is not directly heated. Therefore, in the direct heating type flavor inhaler and the indirect heating type flavor inhaler, a flavor component is not highly volatilization property as compared with that of the conventional combustion type tobacco. In consideration of these circumstances, an object of the present invention is to provide a tobacco rod for a direct heating type or indirect heating type flavor inhaler having high volatilization efficiency of a flavor component.

Solution to Problem

PTL 1 proposes control of a cross-sectional void fraction or the like as a production parameter, but does not mention the relationship between the cross-sectional void fraction and volatilization of a flavor component. Therefore, the present inventors have made earnest studies to find that the above-described problem can be solved by setting a ratio of voids, which has a specific size or more to a specific value. Specifically, the above-described problem is solved by the following present invention.

Embodiment 1

A tobacco rod for a flavor inhaler, comprising a cylindrical container, and a flavor source including tobacco filled in the cylindrical container, in which the flavor source is filled in such a manner as to form voids over a longitudinal direction, and the following relationship is satisfied:

$$S/T \leq 17\%$$

wherein T represents an area of all voids present in a cross-section of the flavor source orthogonal to the longitudinal direction of the cylindrical container, and S represents a total area of voids each having an area of 800000 $\mu m^2$ or more in the cross-section.

Embodiment 2

The tobacco rod according to the embodiment 1, wherein the tobacco rod is for use in a direct heating type or indirect heating type flavor inhaler.

Embodiment 3

The tobacco rod according to the embodiment 2, in which the flavor source comprises a surface-treated flavor generating sheet.

Embodiment 4

The tobacco rod according to the embodiment 2 or 3, in which a side surface of the cylindrical container is made of a material selected from the group consisting of paper, a resin, a metal, and a combination thereof.

Embodiment 5

The tobacco rod according to any one of the embodiments 2 to 4, in which the side surface of the cylindrical container has a multilayer structure.

Embodiment 6

The tobacco rod according to any one of the embodiments 2 to 5, in which the side surface of the cylindrical container has an permeability of less than 1 coresta unit.

Embodiment 7

The tobacco rod according to any one of the embodiments 2 to 6, in which the flavor source comprises a plurality of strip-shaped flavor generating sheets, and a longitudinal direction of the sheets is substantially parallel to the longitudinal direction of the cylindrical container.

Embodiment 8

The tobacco rod according to any one of the embodiments 2 to 7, in which the flavor source comprises an aerosol source that generates aerosol.

Embodiment 9

A direct heating type or indirect heating type flavor inhaler, comprising the tobacco rod according to any one of the embodiments 1 to 8.

Embodiment 10

The flavor inhaler according to the embodiment 9, further comprising an aerosol source that generates aerosol on an upstream side of the tobacco rod.

Embodiment 11

An ultrasonic vibration type flavor inhaler, comprising the tobacco rod according to the embodiment 1.

Advantageous Effects of Invention

The present invention can provide a tobacco rod for a flavor inhaler having high volatilization efficiency of a flavor component.

DESCRIPTION OF EMBODIMENTS

The present invention will now be described in detail. In the present invention, the term "X to Y" embraces end values of X and Y.

1. Tobacco Rod

Figure 1:
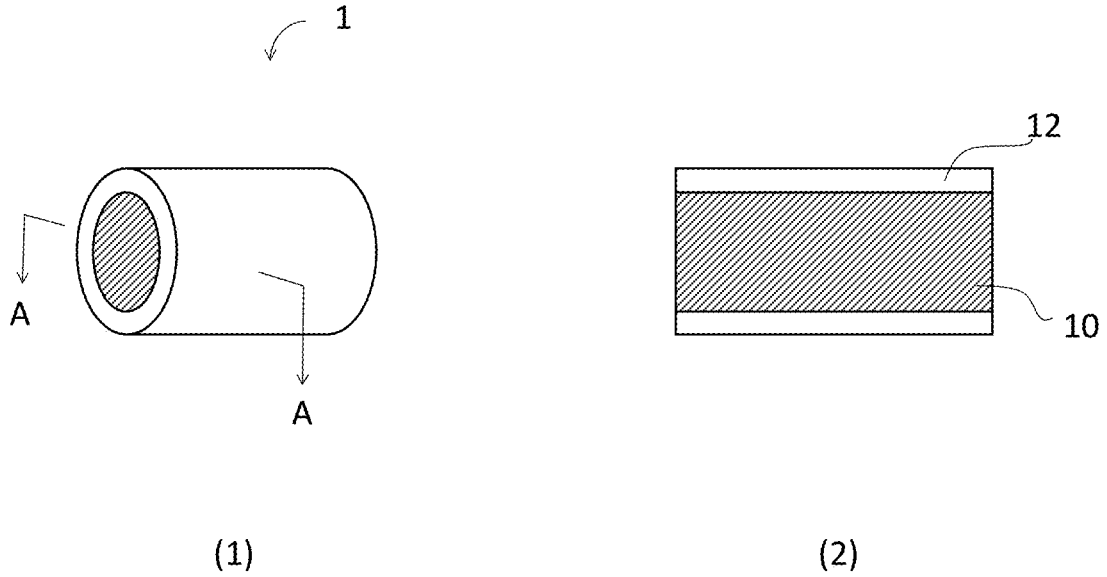
FIG. 1 is a schematic diagram of a tobacco rod.

A tobacco rod refers to a cylindrical member that generates a flavor. A side on a mouthpiece end of the tobacco rod is referred to as the "downstream" side, and the other side is referred to as the "upstream" side. The outline of the tobacco rod is illustrated in FIG. 1. FIG. 1(1) is a perspective view of the tobacco rod, and FIG. 1(2) is a cross-sectional view taken along arrow A-A. In the drawing, a reference sign 1 denotes the tobacco rod, a reference sign 10 denotes a flavor source, and a reference sign 12 denotes a cylindrical container. The cross-sectional shape of the tobacco rod 1 is not limited, and can be a circular, elliptical, polygonal, or rounded polygonal shape. The size of the cross-sectional shape of the tobacco rod 1 is not limited, and the maximum length (hereinafter also referred to as the "width") is preferably 1 mm or more, and more preferably 3 mm or more. The upper limit is preferably 9 mm or less, and more preferably 7 mm or less. The length of the tobacco rod 1 is preferably 40 mm or less, and more preferably 25 mm or less. The lower limit is preferably 1 mm or more, and more preferably 5 mm or more.

(1) Flavor Source

The tobacco rod 1 comprises the flavor source 10 including tobacco. In the flavor source including tobacco (hereinafter also referred to simply as the "flavor source") 10, a void through which aerosol flows is formed over the longitudinal direction. Therefore, the flavor source 10 including tobacco is preferably a flavor generating sheet. The flavor generating sheet can be a sheet in which a component capable of generating a flavor is supported on a sheet substrate, or a sheet made of a material that generates a flavor. Examples of the component capable of generating a flavor include a smoking flavor component contained in a tobacco raw material, and a perfume component such as menthol. The sheet substrate can be, for example, a tobacco material such as a compressed tobacco pellet or a tobacco powder, and is preferably a tobacco material. In other words, the flavor generating sheet may contain a tobacco-derived material in either the sheet substrate or the component capable of generating a flavor, and in one embodiment, a tobacco sheet in which a component capable of generating a flavor if necessary is supported on a substrate sheet of a tobacco material is preferably used.

1) Void Ratio

Figure 2:
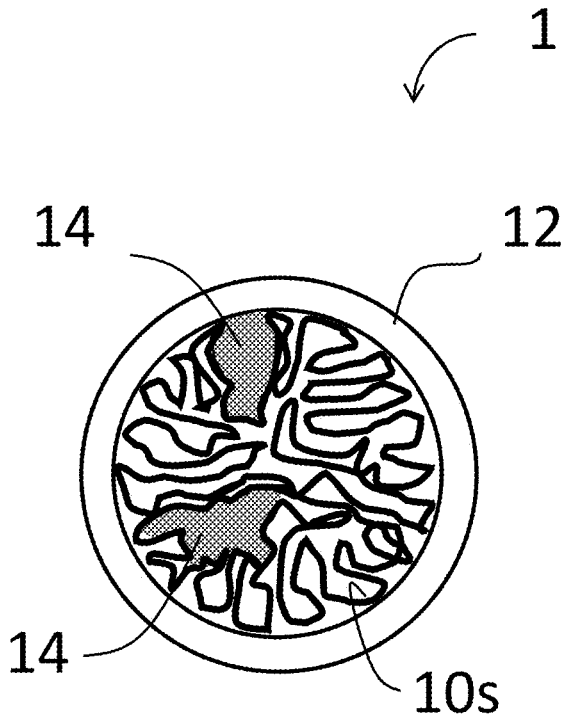
FIG. 2 is a cross-sectional view of a tobacco rod according to one embodiment.

The flavor source 10 is filled in the cylindrical container 12 described below in such a manner as to form a void over the longitudinal direction. FIG. 2 is a cross-sectional view of the tobacco rod 1 in which a flavor generating sheet 10*s* is folded to be filled in the cylindrical container 12 as the flavor source 10. In this case, the number of flavor generating sheets to be filled is not limited, can be 1 to 3, and is preferably 1 from the viewpoint of manufacturability. In the drawing, a reference sign 14 denotes a void having an area of 800000 $\mu m^2$ or more. In the tobacco rod 1 of the present invention, the following relationship is satisfied in the cross-section orthogonal to the longitudinal direction:

$$S/T \leq 17\%$$

T represents an area of all the voids present in the cross-section of the flavor source orthogonal to the longitudinal direction of the cylindrical container, namely, a total area of the voids. S represents a total area of voids each having an area of 800000 $\mu m^2$ or more in the cross-section. Hereinafter, S/T is referred to as V for convenience. An example of a substance to be used for comparison of a volatilization property of a flavor component includes nicotine.

In FIG. 2, V is defined as "the total area of the voids 14"/"the total area of all the voids". When V falls in this range, a volatilization property of the flavor component is good. From this point of view, V is preferably 16% or less, and more preferably 12% or less. The lower limit of V is preferably 0%, but may be 5% or more in consideration of manufacturing convenience. The tobacco rod of the present invention includes voids communicating over the longitudinal direction, and hence, V measured in one position can be defined as V of the tobacco rod.

If the area T of all the voids is excessively small, ventilation resistance is so high that it is difficult to smoke, and if T is excessively large, smoking feeling may be deteriorated in some cases. From this point of view, a preferable lower limit of the ratio of T in the cross-section of the tobacco rod 1 is 10% or more, 20% or more, 30% or more, 35% or more, or 40% or more, and a preferable upper limit is 40% or less, 45% or less, 50% or less, or 60% or less.

V is obtained through observation of an image of the cross-section of the tobacco rod 1. Specifically, a void ratio can be obtained through the following steps:

Step 1: A cross-sectional image of the tobacco rod 1 is obtained.

Step 2: The image is subjected to image analysis to extract voids based on a difference in luminance, and the area T of all the voids is obtained.

Step 3: Voids each having an area of 800000 $\mu m^2$ or more are extracted from the voids, and the total area S thereof is obtained.

Step 4: V is calculated in accordance with the following equation:

$$V(\%)=S/T$$

For the image analysis, known analysis software can be used.

In order to attain such V, the amount of the flavor source 10 to be filled is appropriately adjusted, and in one embodiment, the amount is preferably 40 to 90% by volume based on the volume of the cylindrical container 12. A more preferable lower limit is 50% by volume or more, 55% by volume or more, or 60% by volume or more, and a more preferable upper limit is 60% by volume or less, 65% by volume or less, 70% by volume or less, 80% by volume or less, or 90% by volume or less. Besides, if the flavor generating sheet 10*s* is used as the flavor source 10, at least one surface of the sheet is preferably subjected to a surface treatment. The surface treatment refers to a process for forming a plurality of irregularities on the front surface or the rear surface of the flavor generating sheet 10*s*. The surface treatment is not especially limited, and crimping process, embossing process, debossing process, half cutting process, or the like can be performed. The crimping process is a process for forming wrinkles in the sheet. For example, when the flavor generating sheet 10*s* is allowed to pass between a pair of rollers each having a plurality of projections on the surface, the crimping process can be performed by forming wrinkles extending orthogonally to a sheet conveyance direction on both the front surface and the rear surface of the flavor generating sheet 10*s*. The thus formed projections extend orthogonally to the sheet conveyance direction. A pitch between apexes of the projections provided on the rollers is preferably 0.5 to 2.0 mm. Besides, an apex angle is preferably 30 to 70 degrees. The embossing process and the debossing process refer to a process for forming recesses on one surface or both surfaces of the sheet by pressing a pointed working tool against the sheet, and the half cutting process refers to a process for forming, on one surface or both surfaces of the sheet, a notch having a depth sufficiently small not to cut the sheet, preferably a depth equal to or smaller than a half of the thickness of the sheet.

Figure 3:
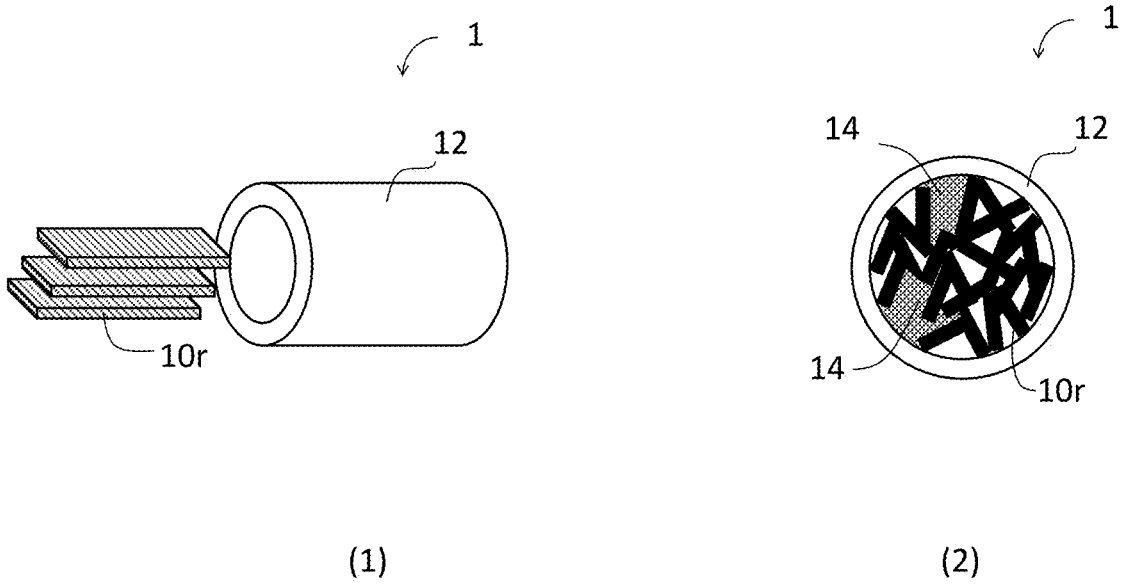
FIG. 3 is a cross-sectional view of a tobacco rod according to another embodiment.

Alternatively, a plurality of strip-shaped flavor generating sheets may be used as the flavor source 10. A strip-shaped sheet refers to a sheet having a length in a short direction, on a principal surface, smaller than the cross-sectional dimension of the cylindrical container 12. FIG. 3(1) illustrates the outline of this embodiment. In this drawing, a reference sign 10*r* denotes the strip-shaped flavor generating sheet. The strip-shaped flavor generating sheets 10*r* are filled with the longitudinal direction aligned substantially in parallel to the longitudinal direction of the cylindrical container 12. FIG. 3(2) is a cross-sectional view of the tobacco rod 1 of this embodiment. Also in this embodiment, V in the above-described range is attained. The strip-shaped flavor generating sheet 10*r* may be subjected to the surface treatment. As a production method for the tobacco rod of the embodiment, a production method disclosed in Japanese Patent Publication No. 62-272962 is known. In producing the tobacco rod of the embodiment, however, a reconstituted tobacco sheet is preferably used as the sheet material instead of a recycled tobacco material, and as the reconstituted tobacco sheet, a sheet obtained by a papermaking process, a slurry sheet, or a cast sheet is preferably used. Besides, a strip of a sheet material pulled out of a bobbin may be subjected to the surface treatment described in the above paragraph before being caused to pass through cutting means.

2) Preparation of Flavor Generating Sheet 10*s*

The flavor generating sheet 10*s* can be prepared by a known method. The flavor generating sheet 10*s* can be prepared by a known method of, for example, a papermaking, slurry, or rolling method. Specifically, in employing the papermaking method, it can be produced by a method comprising the following steps: 1) A dried leaf tobacco raw material is coarsely crushed, and the resultant is separated into a water extract and a residue through extraction with water. 2) The water extract is concentrated by vacuum drying. 3) Pulp is added to the residue, and the resultant is fiberized with a refiner, followed by papermaking. 4) A concentrate of the water extract is added to a sheet resulting from the papermaking, and the resultant is dried to obtain a tobacco sheet.

3) Dimension and the like of Flavor Generating Sheet 10*s*

The shape of the flavor generating sheet 10*s* is not limited, and the principal surface of the sheet is preferably in a rectangular shape. The thickness is not limited, and in consideration of highly efficient heat exchange and the strength of a flavor generating segment, is preferably 200 to 600 μm. One side A of the flavor generating sheet 10*s* preferably has the same length as the length in the longitudinal direction of the cylindrical container 12. The length of the other side B of the flavor generating sheet 10*s* is appropriately adjusted, and in one embodiment, is 1 to 10 times as long as the length of A.

4) Preparation of Strip-Shaped Flavor Generating Sheet 10*r*

The strip-shaped flavor generating sheet 10*r* can be prepared by cutting the flavor generating sheet 10*s*. A length a in the longitudinal direction of the strip-shaped flavor generating sheet 10*r* is preferably the same as the length in the longitudinal direction of the cylindrical container 12. A length b in the short direction of the strip-shaped flavor generating sheet 10*r* is appropriately adjusted, and in one embodiment, is about 0.4 to 3.0 mm, preferably 0.6 to 2.0 mm, and more preferably 0.8 to 1.5 mm.

5) Aerosol Source

The flavor source 10 may include an aerosol source. An example of the aerosol source includes polyol such as glycerin, propylene glycol, or 1,3-butanediol. The amount of the aerosol source to be added is preferably 5 to 50% by weight, and more preferably 10 to 30% by weight based on a dry weight of the flavor source 10. The aerosol source included in the flavor source 10 is referred to also as the "internal aerosol source". When containing the internal aerosol source, the tobacco rod 1 is suitably used for the direct heating type flavor inhaler. As described below, the flavor source 10 for the indirect heating type flavor inhaler preferably does not include the internal aerosol source.

(2) Cylindrical Container

The cylindrical container 12 is made of a known material. For example, a side surface of the cylindrical container 12 is made of a material selected from the group consisting of paper, a resin, a metal, and a combination thereof. When used for the indirect heating type flavor inhaler, the cylindrical container 12 is preferably made of a resin from the viewpoint of handleability. Examples of the resin include polypropylene, polyethylene terephthalate, polyethylene, ABS, and a polylactic acid resin. The thickness of a side surface portion is not limited, and is preferably about 0.4 to 1.0 mm, more preferably about 0.6 to 0.8 mm, and further preferably about 0.7 mm.

When the cylindrical container 12 is used for the indirect heating type flavor inhaler, its side surface is preferably made of a laminate of paper with a resin film such as a polyethylene film, polyvinyl alcohol, or polylactic acid, a laminate of paper with a thin layer formed by coating a solution of a polysaccharide/mucopolysaccharide, such as alginic acid, carrageenan, carboxymethyl cellulose, xanthan gum, guar gum, pectin, mannose, glucuronic acid, locust bean gum, gellan gum, starch, oxidized starch, processed starch, hyaluronic acid, or chondroitin sulfate, a laminate of paper with a metal foil such as an aluminum foil, or cardboard. The number of layers in the laminate is not limited, and a three-layer structure of a paper layer/a resin layer (or a metal foil layer, or a polysaccharide/mucopolysaccharide layer)/a paper layer is preferably employed. Since the paper layer is exposed in such a laminate, it can be sufficiently adhered with a vinyl acetate adhesive or a hot melt adhesive when wound. Thus, sufficient peel strength (22.4 g to 28.0 g) can be attained, and adhesive peeling otherwise caused after winding can be reduced. An example of the paper includes Sandwich Laminate #85/S52 manufactured by Nippon Paper Papylia Co., Ltd. (thickness: 220 μm, basis weight: 85/52 gsm, stiffness: 145 $cm^3$/100). The thickness of the resin layer is preferably 12 to 70 μm, and more preferably 17 to 20 μm.

The cardboard has permeability of preferably less than 50 coresta units, more preferably less than 15 coresta units, and further preferably less than 1 coresta unit. The thickness is preferably 100 to 150 μm, and the basis weight is preferably about 80 to 150 gsm. The cardboard can be one containing 87.5% by weight of kraft pulp, 5% by weight of an inorganic filler, 0.5% by weight of starch, and about 7% by weight of moisture. Such cardboard is available from, for example, Julius Glatz GmbH.

From the viewpoint of satisfactorily improving the volatilization property of the flavor component, the side surface of the cylindrical container 12 has permeability of preferably less than 1 coresta unit, and more preferably 0 coresta unit. A coresta unit refers to air flow volume ($cm^3$) per $cm^2$ and per minute under a condition of 100 mm $H_2O$. The permeability can be measured using an permeability meter PPM100 manufactured by FILTRONA, USA.

One end or both ends of the cylindrical container 12 may be opened, or may be closed with retaining the permeability. If the end is closed, the end is preferably made of the above-described material. Besides, the dimension of the cylindrical container 12 is appropriately adjusted to attain the above-described dimension of the tobacco rod 1.

Figure 4:
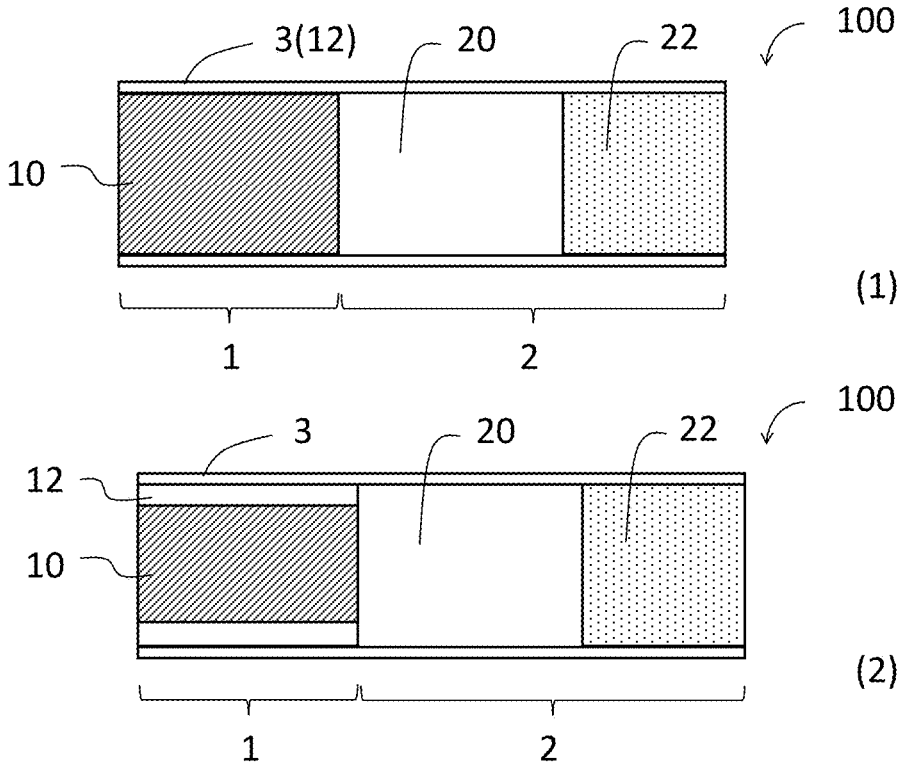
FIG. 4 is a conceptual diagram of a direct heating type flavor inhaler.

2. Direct Heating Type or Indirect Heating Type Flavor Inhaler (1) Direct Heating Type Flavor Inhaler The direct heating type flavor inhaler refers to an article that generates a flavor by heating the flavor source 10. FIG. 4 illustrates one embodiment of the direct heating type flavor inhaler. In this drawing, a reference sign 100 denotes the direct heating type flavor inhaler, the reference sign 1 denotes the tobacco rod, a reference sign 2 denotes a mouthpiece, a reference sign 20 denotes a cooling portion, a reference sign 22 denotes a filter, and a reference sign 3 denotes a wrapper.

The mouthpiece is not limited in the dimension, and preferably has the same width as the tobacco rod 1, and preferably has a length of 26 to 50 mm. The filter 22 is preferably made of a material usually used in this field, such as a cellulose acetate filter. The length of the filter 22 is preferably 12 to 60% of the whole length of the mouthpiece. The cooling portion 20 has a function to cool aerosol. The cooling portion 20 may be hollow, or may have a cooling element such as a polylactic acid film. The cooling portion 20 may be provided with ventilation. The length of the cooling member 20 is preferably 8 to 77% of the whole length of the mouthpiece 2.

As the wrapper 3, the laminate of paper with a resin film such as a polyethylene film, the laminate of paper with a thin film formed by drying a solution of a saccharide/polysaccharide, the laminate of paper with a metal foil such as an aluminum foil, the cardboard described above or the like can be used. In other words, the cylindrical container 12 may be elongated to also work as the wrapper 3 as illustrated in FIG. 4(1). In another embodiment, the wrapper 3 may be provided outside the cylindrical container 12 as illustrated in FIG. 4(2). In this embodiment, the cylindrical container 12 is preferably made of the resin or the cardboard.

The direct heating type flavor inhaler is heated by a known heater. The heater is preferably capable of electrically heating the tobacco rod 1 to 200 to 400° C. In general, the direct heating type flavor inhaler is classified into an internal heating type in which the heater is inserted into the tobacco rod 1, and an external heating type in which the heater is provided around the tobacco rod 1. In the present invention, the latter type is preferably employed for attaining the V of the tobacco rod 1. A combination of the direct heating type flavor inhaler and the heater is also referred to as a direct heating type flavor inhaling system.

(2) Indirect Heating Type Flavor Inhaler

Figure 5:
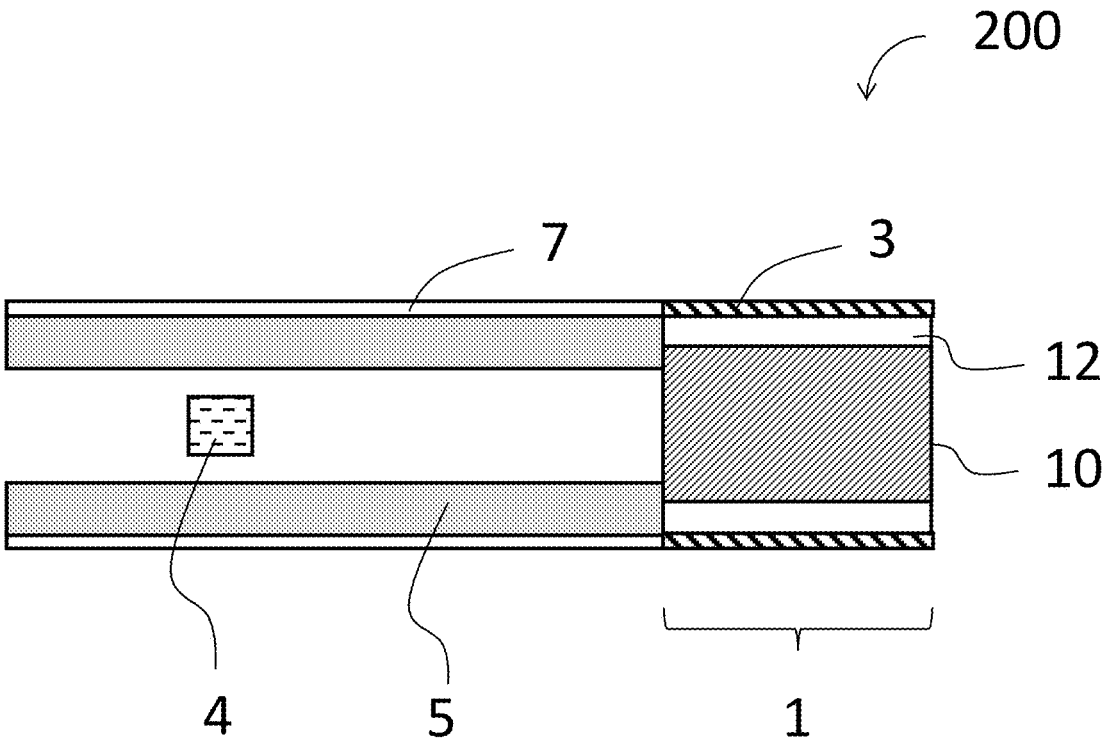
FIG. 5 is a conceptual diagram of an indirect heating type flavor inhaler.

The indirect heating type flavor inhaler refers to an article that generates a flavor without directly heating the flavor source but generating aerosol from the aerosol source disposed on the upstream side to cause a flavor component from the flavor source to be carried on the aerosol. FIG. 5 illustrates an embodiment of the indirect heating type flavor inhaler. In this drawing, a reference sign 200 denotes the indirect heating type flavor inhaler, the reference sign 1 denotes the tobacco rod, the reference sign 3 denotes the wrapper, a reference sign 4 denotes an atomizing portion, a reference sign 5 denotes an external aerosol source, and a reference sign 7 denotes an outer frame. The external aerosol source 5 is disposed on the upstream side of the tobacco rod 1, and aerosol is generated by the atomizing portion 4. The atomizing portion 4 is preferably capable of electrically heating the external aerosol source 5 to about 200 to 300° C. Through this heating, the aerosol is generated, and the aerosol is introduced into the tobacco rod 1, passes therethrough while the flavor source is exposed to an atmosphere of 30 to 40° C., and carries the flavor component which is then inhaled by a user. A combination of the indirect heating type flavor inhaler and a power supply is also referred to as an indirect heating type flavor inhaling system. Known indirect heating type flavor inhaler and indirect heating type flavor inhaling system are disclosed in, for example, International Publication No. WO2016/075749.

Figure 6:
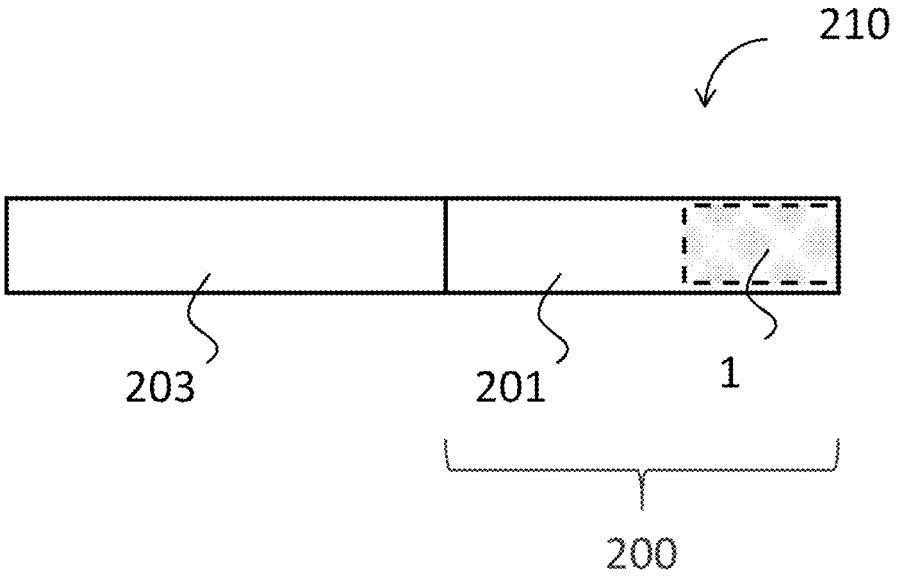
FIG. 6 is a conceptual diagram of an indirect heating type flavor inhaler according to one embodiment.
Figure 7:
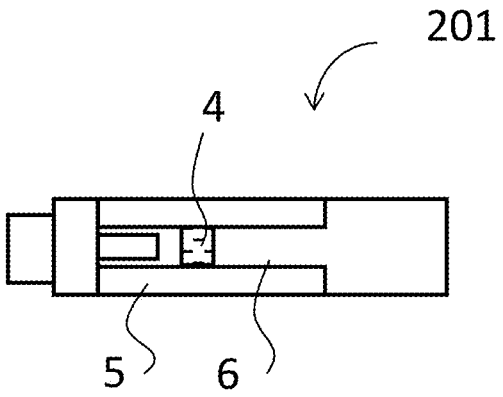
FIG. 7 is a cross-sectional view of a cartridge according to one embodiment.
Figure 8:
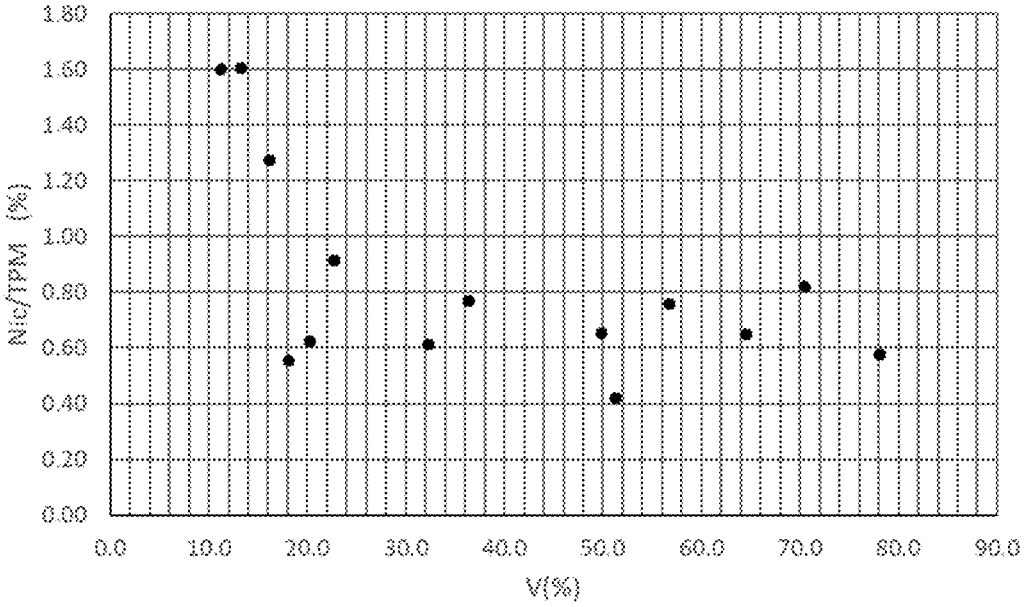
FIG. 8 is a diagram of correlation between V and nicotine.

FIG. 6 illustrates a preferable embodiment of the indirect heating type flavor inhaling system. In this drawing, a reference sign 210 denotes the indirect heating type flavor inhaling system, a reference sign 203 denotes a power supply unit, and a reference sign 210 denotes a cartridge. The cartridge 201 is detachable from the power supply unit 203. As illustrated in FIG. 7, the cartridge 201 includes the external aerosol source 5, the atomizing portion 4, and a passage 6. The tobacco rod 1 is housed in a space disposed at the mouthpiece end in the cartridge 201. The tobacco rod 1 is housed in the space within the cartridge 201 to constitute the indirect heating type flavor inhaler 200. The cartridge 201 may have a filter at the mouthpiece end.

The external aerosol source 5 can be configured by causing the above-described aerosol source to be supported on a porous material such as a fiber filler. The length of the external aerosol source 5 is not limited, and is preferably 10 to 25 mm. The power supply unit 203 includes a power supply such as a battery, and atomizes the aerosol source without causing combustion.

The outer frame 7 of the indirect heating type flavor inhaler can be a resin housing. In the embodiment shown in FIG. 6, the side wall of the cartridge 201 corresponds to the outer frame 7.

Besides, the tobacco rod of the present invention can be used also for an ultrasonic vibration type flavor inhaler, that is, one application of the indirect heating type flavor inhaler. The ultrasonic vibration type flavor inhaler refers to a flavor inhaler employing a system in which an ultrasonic oscillator is used in the atomizing portion to generate aerosol by vibrating the external aerosol source.

EXAMPLES

Examples 1 to 3

A tobacco sheet obtained by a papermaking process (thickness: 200 μm, basis weight: 71 g/m$^2$, nicotine amount: 1.4% by weight) was treated with an alkaline aqueous solution of pH 9.6. Subsequently, the resultant sheet was subjected to a surface treatment using a crimping roller. As the crimping roller, a chevron roller (60 degrees, 1 mm pitch) was used. In this manner, a flavor generating sheet was prepared. The flavor generating sheet was cut into a square shape having a side of 21 mm, and a weight of 310 mg.

As a cylindrical container, a polypropylene straw having a diameter of 8 mm, a wall thickness of 0.2 mm, and a length of 21 mm was prepared. Within the straw, the cut flavor generating sheet folded into the cross-sectional shape as illustrated in FIG. 2 was filled to obtain a tobacco rod. An image analyzer, VHX-2000 (digital microscope manufactured by KEYENCE) was used to obtain an image of an end surface of a sample for a tobacco rod test at a magnification of objective lens of 50 times, and a magnification of CCD-side lens of 10 times. Imaging was performed twice respectively under different conditions described below. Thereafter, the thus obtained two images were overlaid as two image layers using operation software, VHX-2000 ver. 2.3.5.1 attached to the image analyzer. Specifically, the first image was obtained with the end surface brought into focus with lighting intensity automatically set by the operation software attached to the image analyzer. The second image was obtained with the same focus but with maximum (no value) lighting intensity set in the operation software. The first and second images were overlaid by processing these images using "2D Image Merging" function of the operation software to integrate the images into one image data. In order to measure V of the tobacco rod, "Automatic Area Measuring" function of the operation software attached to the image analyzer was applied to the integrated image data, with a threshold value set to 35.

$$V(\%)=S/T$$

T: area of all voids in cross-section

S: total area of voids having area of 800000 μm$^2$ or more

Referring to the description of International Publication No. WO2016/075749, the indirect heating type flavor inhaling system illustrated in FIG. 6 was prepared. The length of the cartridge 200 was 21 mm, which was the same as that of the tobacco rod 1. The system was used to perform machine smoking of 20 puffs. A sample was prepared in accordance with the humidity controlling/conditioning method for tobacco and tobacco products defined by ISO (the International Organization for Standardization) 3402: 1999 (Non Patent Literature). A machine smoking method and a method for collecting a generated aerosol were performed in accordance with CORRESTA RECOMMENDED METHOD No. 81 "ROUTINE ANALYTICAL MACHINE FOR E-CIGARETTE AEROSOL GENERATION AND COLLECTION-DEFINITIONS AND STANDARD". A Cambridge filter in which the aerosol had been trapped was collected to measure a nicotine amount by gas chromatography. A Cambridge filter is a flat circular glass fiber filter having a diameter of about 44 mm and a thickness of 1.5 mm, and is known to and widely used by those skilled in the art as a filter capable of trapping a particulate matter. The Cambridge filter is available from Cambridge Filter Japan, Ltd., Borgwalt (Catalog No. 8020 285 2) and the like. As a representative of flavor components contained in the particulate matter (total particle matter, hereinafter referred to as the "TPM") of the thus trapped aerosol, nicotine was analyzed to obtain a nicotine amount in the TPM. Quantitative determination of nicotine was performed by a method commonly employed by those skilled in the art. Results are shown in Table 1. The amount of the sheet to be filled and the like were changed to attain respective values of V shown in Table 1 to perform Examples 2 and 3.

Comparative Examples 1 to 11

A tobacco rod was prepared in the same manner as in the examples by using a flavor generating sheet not subjected to the crimping process, and the resultant was evaluated. It is noted that the amount of the sheet to be filled and its folding were adjusted to attain respective values of V shown in Table 1.

The flavor generating sheet used in the examples was used to prepare a tobacco rod in the same manner as in the examples, and the resultant was evaluated. It is noted that the amount of the sheet to be filled and its folding were adjusted to attain the respective values of V shown in Table 1. Results of these are shown in Table 1 and FIG. 6.

TABLE 1

| | | Crimping | Amount Filled [mg] | V [%] | Nic/TPM [%] |
|---|---|---|---|---|---|
| Example | 1 | performed | 322 | 16.1 | 1.27 |
| | 2 | performed | 318 | 13.3 | 1.61 |
| | 3 | performed | 319 | 11.2 | 1.60 |
| Comparative Example | 1 | not performed | 316 | 70.5 | 0.82 |
| | 2 | not performed | 313 | 64.6 | 0.65 |
| | 3 | not performed | 306 | 78.1 | 0.58 |
| | 4 | performed | 329 | 22.7 | 0.91 |
| | 5 | performed | 331 | 20.3 | 0.62 |
| | 6 | performed | 318 | 36.4 | 0.77 |
| | 7 | performed | 314 | 56.7 | 0.76 |
| | 8 | performed | 324 | 49.8 | 0.65 |
| | 9 | performed | 303 | 18.1 | 0.55 |
| | 10 | performed | 296 | 51.2 | 0.42 |
| | 11 | performed | 332 | 32.3 | 0.61 |

As shown in Table 1, the tobacco rods of the examples had higher values, than those of the comparative examples, of a ratio of the flavor component contained in the particulate matter of the aerosol generated from the tobacco rod. It is thus obvious that the tobacco rod of the present invention has an excellent volatilization property for a flavor component.

REFERENCE SIGNS LIST

1 tobacco rod
10 flavor source including tobacco
10*s* flavor generating sheet
10*r* strip-shaped flavor generating sheet
12 cylindrical container
14 void having an area of 800000 $\mu m^2$ or more
100 direct heating type flavor inhaler
2 mouthpiece
20 cooling portion
22 filter
3 wrapper
200 indirect heating type flavor inhaler
210 indirect heating type flavor inhaling system
201 cartridge
4 atomizing portion
5 external aerosol source
6 passage
7 outer frame
203 power supply unit

The invention claimed is:

1. A tobacco rod for a flavor inhaler, comprising a cylindrical container, and a flavor source including tobacco filled in the cylindrical container, wherein the flavor source is filled in such a manner as to form voids over a longitudinal direction, and the following relationship is satisfied:

$$S/T \leq 17\%$$

wherein T represents an area of all voids present in a cross-section of the flavor source orthogonal to the longitudinal direction of the cylindrical container, and S represents a total area of voids each having an area of 800000 $\mu m^2$ or more in the cross-section.

2. The tobacco rod according to claim 1, wherein the tobacco rod is for use in a direct heating type or indirect heating type flavor inhaler.

3. The tobacco rod according to claim 2, wherein the flavor source comprises a surface-treated flavor generating sheet.

4. The tobacco rod according to claim 2, wherein a side surface of the cylindrical container is made of a material selected from the group consisting of paper, a resin, a metal, and a combination thereof.

5. The tobacco rod according to claim 2, wherein a side surface of the cylindrical container has a multilayer structure.

6. The tobacco rod according to claim 2, wherein a side surface of the cylindrical container has an permeability of less than 1 coresta unit.

7. The tobacco rod according to claim 2, wherein the flavor source comprises a plurality of strip-shaped flavor generating sheets, and a longitudinal direction of the sheets is substantially parallel to the longitudinal direction of the cylindrical container.

8. The tobacco rod according to claim 2, wherein the flavor source comprises an aerosol source that generates aerosol.

9. A direct heating type or indirect heating type flavor inhaler, comprising the tobacco rod according to claim 1.

10. The flavor inhaler according to claim 9, further comprising an aerosol source that generates aerosol on an upstream side of the tobacco rod.

11. An ultrasonic vibration type flavor inhaler, comprising the tobacco rod according to claim 1.

12. The tobacco rod according to claim 3, wherein a side surface of the cylindrical container is made of a material selected from the group consisting of paper, a resin, a metal, and a combination thereof.

13. The tobacco rod according to claim 3, wherein the side surface of the cylindrical container has a multilayer structure.

14. The tobacco rod according to claim 4, wherein the side surface of the cylindrical container has a multilayer structure.

15. The tobacco rod according to claim 3, wherein the side surface of the cylindrical container has an permeability of less than 1 coresta unit.

16. The tobacco rod according to claim 4, wherein the side surface of the cylindrical container has an permeability of less than 1 coresta unit.

17. The tobacco rod according to claim 5, wherein the side surface of the cylindrical container has an permeability of less than 1 coresta unit.

18. The tobacco rod according to claim 3, wherein the flavor source comprises a plurality of strip-shaped flavor generating sheets, and a longitudinal direction of the sheets is substantially parallel to the longitudinal direction of the cylindrical container.

19. The tobacco rod according to claim 4, wherein the flavor source comprises a plurality of strip-shaped flavor generating sheets, and a longitudinal direction of the sheets is substantially parallel to the longitudinal direction of the cylindrical container.

20. The tobacco rod according to claim 1, wherein the following relationship is satisfied: $5\% \leq S/T \leq 17\%$.

* * * * *